US006010309A

United States Patent [19]

Takamura et al.

[11] Patent Number: 6,010,309

[45] Date of Patent: Jan. 4, 2000

[54] CONTROL DEVICE FOR VARIABLE CAPACITY PUMP

[75] Inventors: Fujitoshi Takamura, Hirakata; Seiichi Fuchita, Katano; Junichi Tanaka, Hirakata, all of Japan

[73] Assignee: Komatsu Ltd., Tokyo, Japan

[21] Appl. No.: 09/016,601

[22] Filed: Jan. 30, 1998

[30] Foreign Application Priority Data

Jan. 31, 1997 [JP] Japan ..... 9-033167

[51] Int. Cl.[7] ..... F04B 49/06

[52] U.S. Cl. ..... 417/22; 417/218; 60/449

[58] Field of Search ..... 417/22, 213, 218, 417/222.1, 278, 280, 364; 60/445, 449, 452

[56] References Cited

U.S. PATENT DOCUMENTS

| | | | |
|---|---|---|---|
| 4,332,531 | 6/1982 | Marietta | 417/218 |
| 4,528,813 | 7/1985 | Izumi et al. | 417/218 |
| 4,637,781 | 1/1987 | Akiyama et al. | 417/218 |
| 4,809,504 | 3/1989 | Izumi et al. | 60/449 |
| 4,823,552 | 4/1989 | Ezell et al. | 417/218 |
| 4,904,161 | 2/1990 | Kamide et al. | 417/218 |
| 5,468,126 | 11/1995 | Lukich | 417/218 |
| 5,881,629 | 3/1999 | Gollner et al. | 417/218 |

FOREIGN PATENT DOCUMENTS 8-218442 8/1996 Japan .

*Primary Examiner*—Willis R. Wolfe
*Attorney, Agent, or Firm*—Sidley & Austin

[57] ABSTRACT

A controller, for a variable capacity pump, prevents engine stalls due to rapid changes in operating load by increasing the pump absorption torque when the engine speed is high so as to increase the work amount and by reducing the pump absorption torque when the engine speed is low. The controller receives a signal from an engine speed sensor for detecting engine speed. A pump absorption torque curve is pre-set so as to be consecutively stepped with respect to engine speed so as to intersect at an engine rated point. The pump absorption torque is then calculated in accordance with increases or decreases in engine speed. The pump absorption torque is then set to prescribe values based on the results of these calculations and an instruction is outputted to a control valve in such a manner as to regulate a regulator of the variable capacity pump.

4 Claims, 3 Drawing Sheets

CONTROL DEVICE FOR VARIABLE CAPACITY PUMP

FIELD OF THE INVENTION

The present invention relates to a control device, for a variable capacity pump, for storing a pump absorption torque curve matching with engine output torque at a rated engine speed and for controlling the pump absorption torque, depending upon increases and decreases in the engine speed, based on the stored pump absorption torque curve in order to simplify operations with respect to fluctuations in load at the time of operation of construction machinery, such as a hydraulic shovel, etc.

BACKGROUND OF THE INVENTION

A related control device for a variable capacity pump for construction machinery such as a hydraulic shovel, etc., was described by this applicant in Japanese Patent Application No. Hei. 7-46508 (1995). This construction machinery control device is applied to a variable capacity pump including an engine; a variable capacity pump, driven by the engine; a pump output controller, for exerting control in such a manner that the product of the load pressure and the discharge amount at the pump becomes approximately fixed; an operating device, operated by an actuator receiving pressurized oil from the pump; and a switch, for selecting engine output torque and variable capacity pump absorption torque, depending on the operating site or the operation contents. The control device includes an active mode selector, for demanding operations such as heavy excavating, etc.; an engine fuel injection position setting means, for supplying fuel so that the engine outputs the rated output torque in response to the active mode selection; an active mode switcher means, for switching over pressure settings of relief valves and safety valves, etc., for adjusting oil pressure going to the actuator during an active mode; and a controller, for receiving a signal from the active mode selector and for outputting an instruction to the engine fuel injection position setting means and the active mode switcher.

The control device for a variable capacity pump determines the hydraulic pump discharge flow rate Q (Q=q(cc/rev).N) corresponding to the engine speed N, exerts control in such a manner that the product of the discharge flow rate Q and the discharge pressure P of the hydraulic pump becomes constant (P.Q=constant), and controls the hydraulic pump absorption horsepower to be approximately constant.

In recent years, changes have been made to these P-Q charts and to matching points of the engine output torque and the pump absorption torque in order to increase the operating power and the speed in line with the load conditions of the operations.

However, in order to exert control so as to select either one of the point of view of the amount of work or the point of view of the fuel conservation in response to the operating conditions, the control device for a variable capacity pump of Japanese Patent Application No. Hei. 7-46508 carries out a variable control of the engine output, a variable control of the pump absorption torque, and a variable control of the pressure increases in an oil pressure circuit. The control device is therefore complicated, which means that the durability of each control system has to be increased to cope with the vibrations of the construction machinery, which causes costs to increase.

However, various kinds of construction equipment, such as hydraulic shovels, etc., from large types to small types, are used in a wide range of applications from work quarrying mines to municipal engineering work, with both the usage at work sites and the work loads being different.

The type of equipment for carrying out heavy load operations requires a variable control of the engine output, a variable control of the pump absorption torque, and a variable control of the pressure increases in an oil pressure circuit. However, with general engineering work where there is little operation with a heavy load, the aforementioned variable control of the engine output and the variable control of the pressure rises in an oil pressure circuit are no longer required; and a simple control, where a control is exerted to make pump absorption torque a prescribed value in accordance with increases or decreases in engine speed, can instead be carried out.

SUMMARY OF THE INVENTION

As the present invention sets out to resolve the aforementioned problems of the related art, it is the object of the present invention to provide a control device for a variable capacity control pump where the pump absorption torque is set in accordance with increases or decreases in the engine speed in such a manner as to prevent engine stalls due to sudden increases in the work load by, depending on the work site and working conditions, increasing the pump absorption torque so as to increase the amount of work when the engine is operating at high speeds and reducing the pump absorption torque when the engine is working at low speeds.

In order to achieve the aforementioned object, according to the present invention, there is provided a control device for a variable capacity pump. The variable capacity pump has an engine; a variable capacity pump unit, driven by the engine; and a regulator, for controlling a swash plate angle of the variable capacity pump unit. The control device for this variable capacity pump comprises an engine speed sensor, a control valve, a first controller and a second controller. The engine speed sensor is for detecting the engine speed. The control valve is for regulating a control pressure to the regulator. The first controller is for pre-storing a pump absorption torque curve, consecutively increasing and decreasing in steps in accordance with increases and decreases in the speed of the engine. The first controller further outputs a pump absorption torque instruction, corresponding to an engine speed signal from the engine speed sensor based on the stored pump absorption torque curve, when controlling the variable capacity pump. The second controller is for pre-storing a curve of control current values, going to the control valve, corresponding to the pump absorption torque. The second controller further outputs to the control valve a control current value control instruction corresponding to a value of the pump absorption torque instruction from the first controller, based on the curve of control current values.

According to the present invention, a control is exerted in such a manner that the pump absorption torque is increased in accordance with this high engine speed when the amount of work is caused to increase. In this way, the working power is increased, as is the amount of work. Conversely, when the work load is light, the pump absorption torque is decreased according to the reduced engine speed. This means that the engine does not stall due to sudden increases in the work load.

Therefore, as the pump absorption torque is set in accordance with increases and decreases of the engine speed, engine stalls due to increases in the amount of work can be prevented and operability is improved.

Further, according to the present invention, the pump absorption torque is stored in the first controller as a pattern set as a function of target engine speed, with the pattern being fixed in such a manner that the pump absorption torque does not fluctuate unless the target engine speed changes.

Therefore, a simpler controller can be configured because of the fixed pattern where the pump absorption torque does not fluctuate unless the engine speed changes. The regulator for the variable capacity pump can therefore regulate in such a manner as to give the correct pump absorption torque values in line with the actual work load (increases or decreases in engine speed) and the operability is improved as a result. A simple controller, which is free from faults due to vibrations, etc., can therefore be provided at a low manufacturing cost.

Moreover, according to the present invention, the pump absorption torque is stored in the first controller in accordance with the increases and decreases in the target engine speed and the increases or decreases in steps for the whole region of the engine speed. Here, a high position pump absorption torque value is larger than a rated engine output torque value for engine speeds higher than the rated engine speed; an intermediate position pump absorption torque value is an intermediate value, smaller than the rated engine output torque value, for engine speeds lower than the rated engine speed; and a low position pump absorption torque value is smaller than the intermediate position pump absorption torque value for engine speeds much lower than the rated engine speed.

The pump absorption torque curve is such that transitions from the high position pump absorption torque value to the intermediate position pump absorption torque value, and transitions from the intermediate position pump absorption torque value to the low position pump torque value are set to have prescribed gradients.

As a result, a simple controller can be constructed because the pattern increasing or decreasing in steps can set pump absorption torque values for a plurality of stages for high positions to low positions for the entire range of engine speeds without the pump absorption torque fluctuating unless the engine speed is changed. The regulator for the variable capacity pump can therefore regulate in such a manner as to give the correct pump absorption torque values in line with the actual work load (increases or decreases in engine speed) and operability is improved as a result. A simple controller, in which faults due to oscillations, etc., do not occur can therefore be provided at a low manufacturing cost.

DETAILED DESCRIPTION OF THE PREFERRED EMBODIMENT

Figure 1:
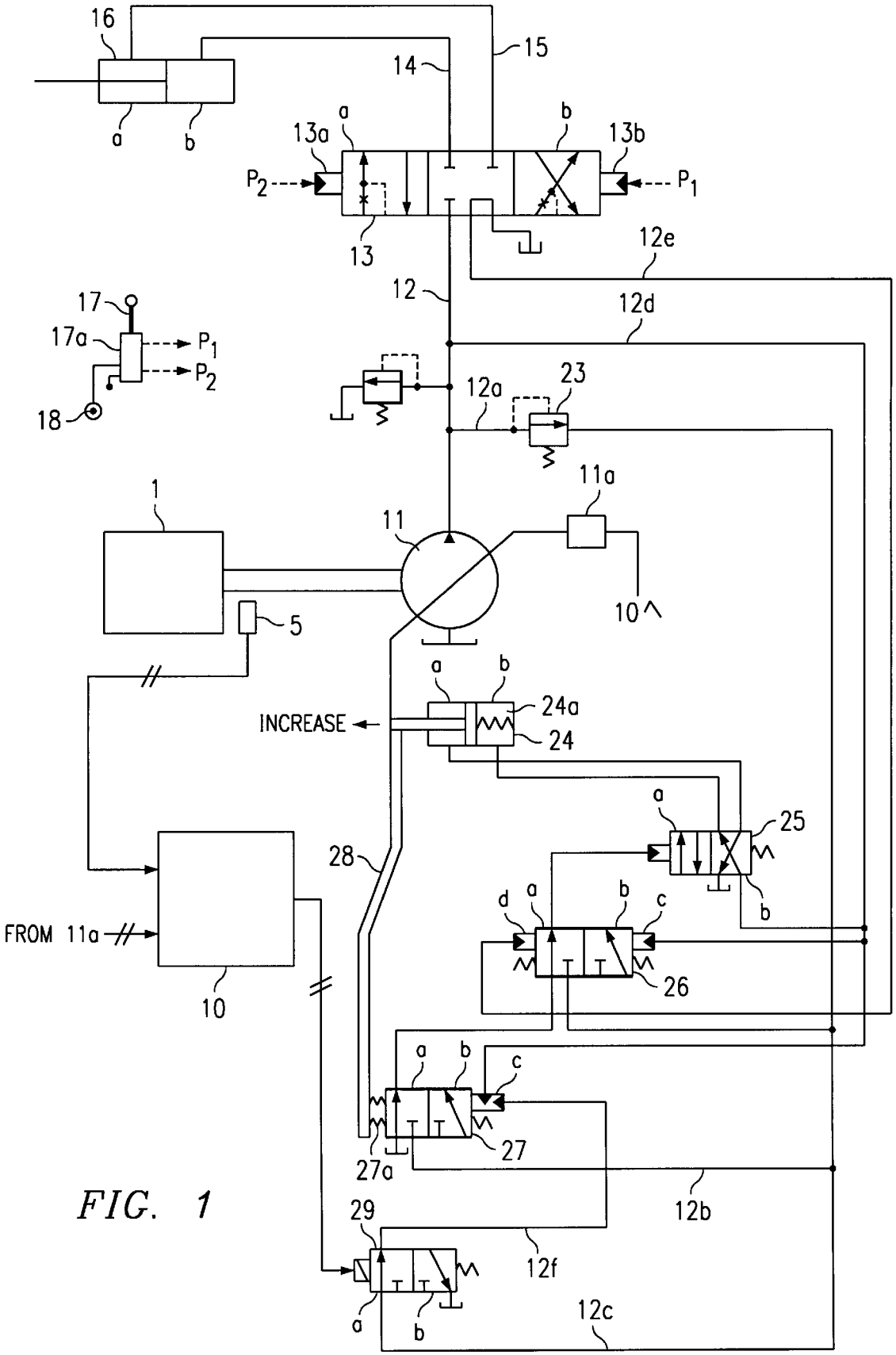
FIG. 1 is a schematic view illustrating a control device for a variable capacity pump in accordance with the present invention.

The following is a description, using FIG. 1 to FIG. 5, of an embodiment of a control device for a variable capacity pump shown in FIG. 1.

An engine speed signal, from an engine speed sensor 5 for detecting the rotational speed of an output shaft of an engine 1, is inputted to a controller 10. The engine 1 drives a variable capacity pump 11 (hereinafter referred to as "pump 11"). Pressurized oil, discharged from this pump 11, is supplied to a hydraulic cylinder 16 via a discharge pipe 12, a direction changeover valve 13, and pipes 14 and 15.

The hydraulic cylinder 16 is shown in FIG. 1 as an oil pressure cylinder for use with a boom, an arm, or a bucket, which are members of an operating unit for a hydraulic shovel. In FIG. 1 only one hydraulic cylinder circuit is shown but the other hydraulic circuits for the operating unit are of the same configuration, and are omitted. A pilot pressure generator 17*a,* that operates in unison with an operating unit lever 17, outputs pilot pressures P1 and P2 from a hydraulic source 18 to hydraulic operating parts 13*a* and 13*b* of the direction changeover valve 13. For example, the pilot pressure P1, outputted using the operating unit lever 17, acts on the hydraulic operating part 13*b* of the direction changeover valve 13. This results in the direction changeover valve 13 being changed over to its position b, and pressurized oil is discharged from the pump 11 through the direction changeover valve 13 so as to flow via the pipe 15 into the head chamber a of the hydraulic cylinder 16. Oil in the bottom chamber b of the hydraulic cylinder 16 is then drained via the pipe 14 and the direction changeover valve 13 to the tank, so that the hydraulic cylinder 16 is compressed.

When the pilot pressure P2, outputted using the operating unit lever 17, acts on the operation part 13*a,* the direction changeover valve 13 is changed over to its position a. Pressurized oil, discharged from the pump 11, flows via the discharge pipe 12, the direction changeover valve 13, and the pipe 14 into the bottom chamber b of the hydraulic cylinder 16. Oil in the head chamber a of the hydraulic cylinder 16 is then drained to the tank via the pipe 15 and the direction changeover valve 13 so that the hydraulic cylinder 16 is expanded.

The swash plate angle of the pump 11 is controlled by a servo piston 24. A servo valve 25, supplying a control pressure to this servo piston 24, is connected with a conduit 12*d,* which diverges from the discharge pipe 12 of the pump 11. This servo valve 25 is connected to a torque variable control valve 27 (hereinafter referred to as "TVC valve 27") for controlling the output for pump 11, via a load sensor valve 26 (hereinafter referred to as "LS valve 26"), to be of an almost constant horsepower.

One end of a conduit 12*b* is connected to this TVC valve 27, and the other end of the conduit 12*b* is connected to a conduit 12*a,* which branches from the discharge pipe 12 of the pump 11, and which contains a self pressure control valve 23 at a location between the pipe 12 and the pipe 12*b*.

A first hydraulic operating part c of the LS valve 26 is connected to a conduit 12*d,* which diverges from the discharge pipe 12 of the pump 11; and the second hydraulic operating part d of the LS valve 26 is connected to the conduit 12*e,* which indicates the load pressure of the hydraulic cylinder 16 as detected via the direction changeover valve 13.

The operation of the LS valve 26 is controlled depending upon the difference in pressure between the discharge pressure of the pump 11 and the load pressure of the hydraulic cylinder 16.

The hydraulic operating part c of the TVC valve 27 is connected to the discharge pipe 12 of the pump 11 via a conduit 12*f*, a control valve 29 in its open position a, a conduit 12*c*, the self pressure control valve 23, and the conduit 12*a*. The conduit 12*d* is also connected to the hydraulic operating part c of the TVC valve 27. The TVC valve 27 is provided with two springs 27*a* that come into contact with a pressing member 28, which is coupled to the piston of the servo piston 24. The springs 27*a* are pressed by a piston, not shown in the drawings, for the TVC valve 27 so as to flex; and the pressing member 28 presses so that the servo piston 24 operates and the swash plate angle of the pump 11 is controlled. The discharge capacity of the pump 11 can therefore be varied using this control and the absorption horsepower of the hydraulic pump is controlled to be a uniform line of almost constant horsepower (P.Q=constant). The control valve 29 is actuated by a signal from the controller 10.

A detection sensor 11*a* for detecting the swash plate angle of the pump 11 is connected to the controller 10. A regulator for controlling the swash plate angle of the pump 11 is comprised of the servo piston 24, the servo valve 25, the LS valve 26, and the TVC valve 27.

A description will now be given of a control circuit for the controller 10 using FIG. 2 and referring to FIG. 1. The engine speed signal, from the engine speed sensor 5 for detecting the engine speed, is inputted to a first controller 10*a*. This first controller 10*a* pre-stores a curve of the pump absorption torque consecutively increasing or decreasing in stages in accordance with increases or decreases in the engine speed. To control the pump 11, the first controller 10*a* outputs a pump absorption torque instruction to a second controller 10*b* in accordance with an engine speed signal from the engine speed sensor 5 based on the stored pump absorption torque curve.

The second controller 10*b* pre-stores a curve of control current values for the control valve 29 corresponding to the pump absorption torque. The second controller 10*b* further outputs to the control valve 29 control instructions for control current values corresponding to pump absorption torque instruction values from the first controller 10*a* based on the curve of control current values. The first controller 10*a* therefore outputs pump absorption torque T1 to the second controller 10*b* when the engine speed is No, and outputs pump absorption torque T2 to the second controller 10*b* when the engine speed is N2. This second controller 10*b* then outputs to the control valve 29 either a control current value i1, corresponding to pump absorption torque T1, or a control current value i2, corresponding to pump absorption torque T2.

Figure 3:
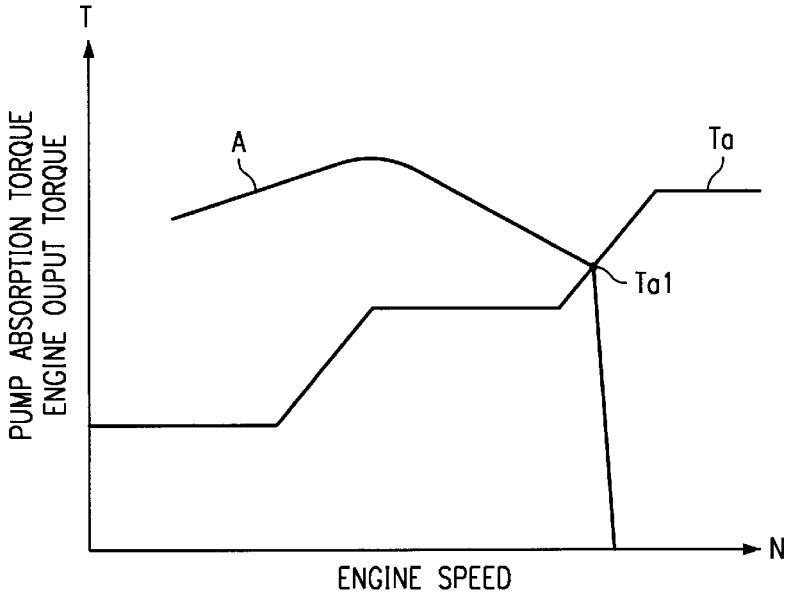
FIG. 3 is a view illustrating the relationship between the engine output torque and the pump absorption torque for the control device for a variable capacity pump in accordance with the present invention.

The following is a description, using FIG. 3, of a matching point of a pump absorption torque curve Ta and an engine output torque curve A.

As is known from the above, the pump absorption torque curve Ta, pre-stored in the first controller 10*a* of the controller 10, is made to match with the engine output torque curve A at a point Ta1. As shown in FIG. 3, a stepped state is set for the pump absorption torque curve Ta so that the pump absorption torque goes consecutively up in stages as the engine speed goes higher and the pump absorption torque goes consecutively down in stages as the engine speed goes down. This pump absorption torque curve Ta is fixed with respect to the engine output torque curve A.

Figure 4:
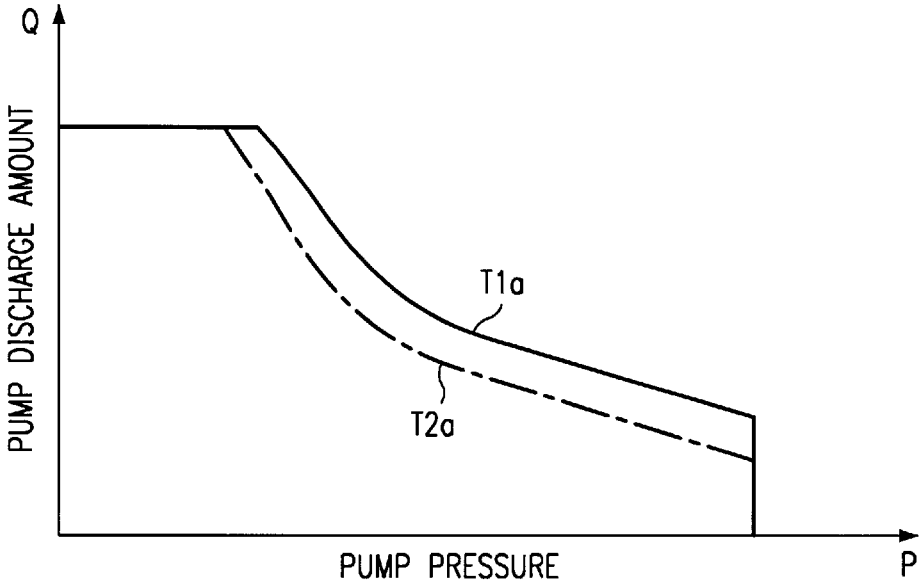
FIG. 4 is a P-Q chart of pump pressure and pump discharge amount for the control device for a variable capacity pump in accordance with the present invention.

FIG. 4 is a view illustrating the relationship between the pump discharge pressure P and the pump discharge amount Q. As the pump discharge amount Q is $$Q=q(cc/rev).\ N$$

when the engine speed is taken to be N, the pump discharge pressure is taken to be P, and the discharge amount per pump revolution is taken to be q (cc/rev), the pump absorption horsepower is controlled to be on a fixed line of an almost constant horsepower (P.Q=constant). Here, the discharge amount q (cc/rev) per pump rotation is controlled by the controller 10 in response to a signal from the detection sensor 11*a* for detecting the swash plate angle shown in FIG. 1.

It is also possible to pre-store in the controller 10 the relationship between the pump discharge pressure P and the discharge amount q as a map, and to control the discharge amount q (cc/rev) per revolution of the pump by detecting the discharge pressure P.

Figure 2:
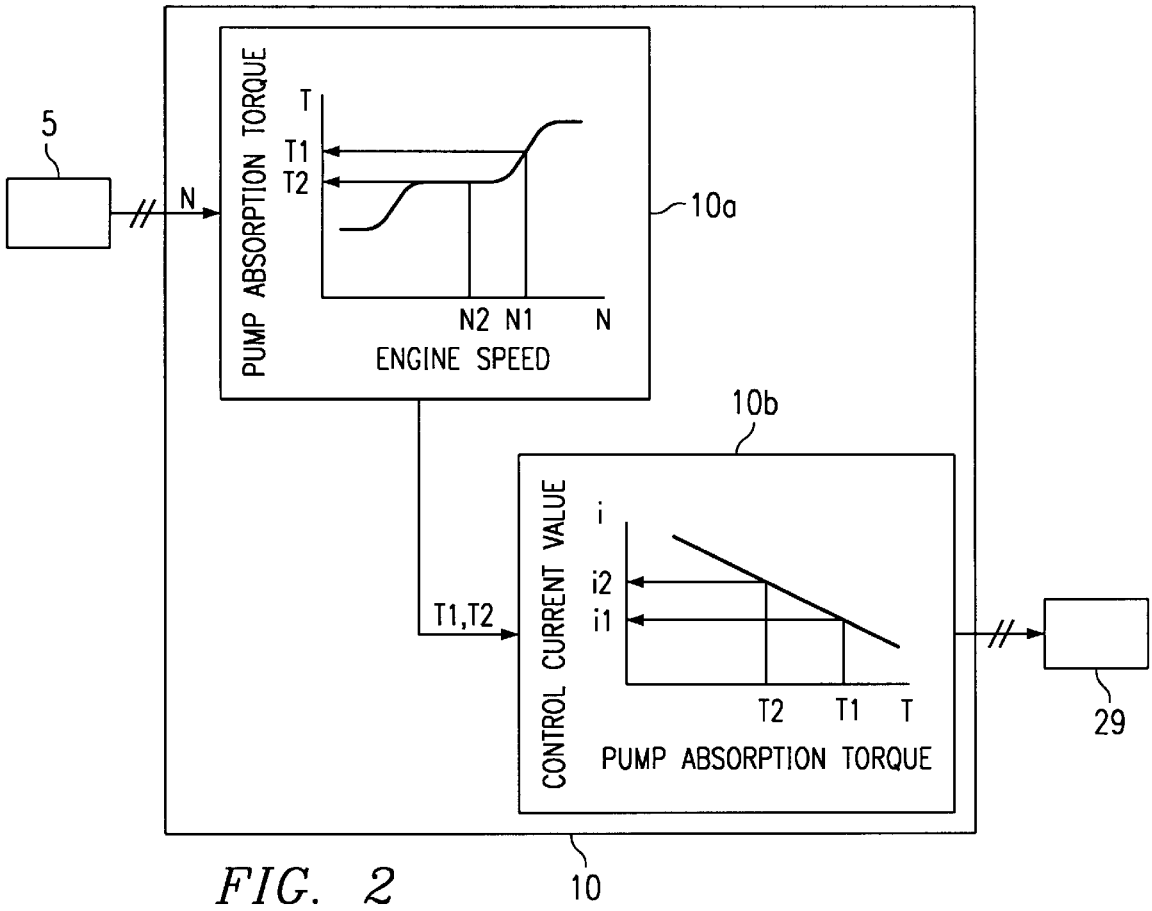
FIG. 2 is a schematic view illustrating a controller of the control device for a variable capacity pump in accordance with the present invention.

The line T1a for P-Q shown in FIG. 4 shows a control for when the pump absorption torque T1 corresponds to the engine speed N1 described in FIG. 2. The line for T2a for P-Q shows a control for when the pump absorption torque T2 corresponds to the engine speed N2 of FIG. 2. The pump absorption torque can therefore be set to a prescribed value in accordance with increases or decreases in engine speed.

Figure 5:
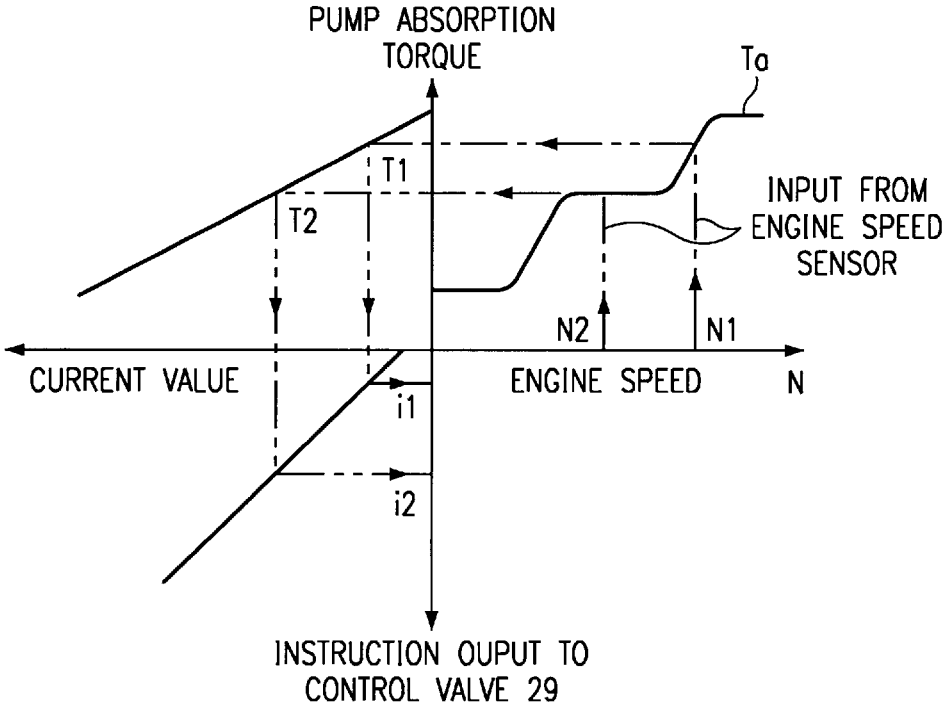
FIG. 5 is a view illustrating control logic for the control device for a variable capacity pump in accordance with the present invention.

FIG. 5 shows the logic for a control device for a variable capacity pump of the present invention shown in FIG. 1 to FIG. 4, with a description being given with reference to FIG. 1 to FIG. 4.

A pump absorption torque of T1 is set at the time of a high engine speed N1. The control current value i1 is outputted to the control valve 29 in accordance with this pump absorption torque T1. As a result of this, the control valve 29 is moved from its closed position b to its open position a in accordance with this control current value i1. As a result of this, the pump pressure from the pump 11 is controlled by the self pressure control valve 23 via the conduit 12*a*, and is supplied via the conduit 12*c* and the control valve 29 so as to operate the hydraulic operation part c of the TVC valve 27.

A pump absorption torque T2 is set at the time of a low engine speed N2. A control current value i2, corresponding to this pump absorption torque T2, is outputted to the control valve 29. As a result, the control valve 29 opens in accordance with this control current value i2. As a result of this, the pump pressure from the pump 11 is controlled by the self pressure control valve 23, and is supplied via the conduits 12*a*, 12*c*, and 12*f*, and the control valve 29 so as to operate the hydraulic operation part c of the TVC valve 27.

The following is a description of the operation shown in FIG. 1 to FIG. 5.

First, a description is given of the regulator for controlling the swash plate angle of the pump 11. When the pump pressure P1, discharged from the pump 11 shown in FIG. 1, is used to operate the hydraulic operating part c of the LS valve 26 via conduit 12*d*, and the load pressure P2 of the hydraulic cylinder 16 is used to operate the hydraulic operating part d of the LS valve 26 via the conduit 12*e*, with P1<P2 and the pump pressure P1 being low, the LS valve 26 is in its position a. When the pump pressure P1, discharged from the pump 11, operates the hydraulic operating part c of the TVC valve 27 via the conduit 12*d* and this pump pressure P1 is low, the TVC valve 27 is pushed by the springs 27*a* so as to be in its drain position a.

The control pressure applied to the hydraulic operating part of the servo valve 25 is therefore made to return to the tank through the LS valve 26, in its drain position a, and through the TVC valve 27, in its drain position a.

As a result, the servo valve 25 moves from its position a to its position b, and the control pressure discharged from the pump 11 passes through the conduit 12*d* and the servo valve 25, in its position b, to be used in chamber b of the servo piston 24. Control is then exerted in such a manner that the servo piston 24 is shifted toward the left side, the swash plate angle of the pump 11 is made large, and the pump discharge amount is increased.

When the pump pressure discharged from the pump 11 goes high, this pump pressure operates the hydraulic operating part c of the TVC valve 27 and the TVC valve 27 is changed over to its position b to supply pressure from conduit 12*b* to the LS valve 26.

The control pressure discharged from the pump 11 therefore operates the hydraulic operating part of the servo valve 25 via the conduit 12*b,* the TVC valve 27 in its position b, and the LS valve 26 in its position a.

As a result, the servo valve 25 is also changed over to its position a, and the control pressure, discharged from the pump 11, goes to the chamber a of the servo piston 24 via the conduit 12*d* and the servo valve 25, in its position a. Control is then exerted so that the servo piston 24 is then shifted toward the right side, the swash plate angle of the pump 11 is made small, and the pump discharge amount is reduced.

An engine speed signal, representative of the engine speed, is inputted to the controller 10 from the engine speed sensor 5. As illustrated in FIG. 2, when the engine speed is a high number N1, the pump torque T1 is set and the control current value i1, corresponding to this pump absorption torque T1, is outputted from the controller 10 to the control valve 29. Further, the pump absorption torque T2 is set when the engine speed is a low number N2, with the control current value i2, corresponding to this pump absorption torque T2, then being outputted from the controller 10 to the control valve 29. The control current value i1 or i2 is then used to operate the hydraulic operating part c of the TVC valve 27 and the TVC valve 27 is controlled.

Two springs 27*a* are provided at the TVC valve 27 so as to come into contact with the pressing member 28, which is coupled to the piston of the servo piston 24. These two springs 27*a* are pressed and flexed by a piston, not shown in the drawings, of the TVC valve 27, the pressing member 28 is pressed and the servo piston 24 operates so as to control the swash plate angle of the pump 11. The discharge capacity of the pump 11 is made variable by this control, and the pump absorption horsepower is controlled to be on a fixed line of almost constant horsepower of P.Q=constant.

When the engine speed is high as shown in FIG. 4, a control is exerted in accordance with T1a of the P-Q chart; and when the engine speed is low a control is exerted in accordance with Ta2 of the P-Q chart.

According to the control device for a variable capacity pump of the present invention, when the engine speed is high, a control is exerted so as to increase the pump absorption torque to correspond to this high engine speed. The operating power is therefore increased and the operating amount is also made to increase.

When the engine speed is reduced for light loads, a control is exerted so as to reduce the pump absorption torque so as to correspond to this low engine speed. This means that the engine will not stall even when there is a sudden increase in load. As the pump absorption torque can be set in accordance with increases and decreases in the engine speed in this way, engine stalls due to increases in the work load can be prevented and operability can be improved.

Further, as the pump absorption torque is stored in the first controller 10*a* as a pattern set as a function of the target engine speed, this pattern for the pump absorption torque does not fluctuate outside changes for the target engine speed. Use of the fixed pattern, in which the pump absorption torque does not fluctuate outside changes in the engine speed, can simplify the control circuit.

The variable capacity pump regulator can therefore be regulated so as to give a correct pump absorption torque value that matches with the actual work load (increases or decreases in the engine speed).

Further, the pump absorption torque is stored in the first controller 10*a* in accordance with increases and decreases in the target engine speed and consecutively increases or decreases in steps for the whole region of the engine speed. Here, a high position pump absorption torque value is larger than a rated engine output torque value for engine speeds higher than the rated engine speed. Moreover, an intermediate position pump absorption torque value is an intermediate value, smaller than the rated engine output torque value, for engine speeds lower than the rated engine speed. A low position pump absorption torque value is then smaller than the intermediate pump absorption torque value for engine speeds much lower than the rated engine speed. The pump absorption torque curve is such that transitions from the high position pump absorption torque value to the intermediate position pump absorption torque value, and transitions from the intermediate pump absorption torque value to the low position pump torque value are set to have prescribed gradients.

This means that a simple controller can be constructed because the pattern increasing and decreasing in steps can set pump absorption torque values for a plurality of stages for high positions to low positions for the entire range of engine speeds without the pump absorption torque fluctuating unless the engine speed is changed. The variable capacity pump regulator can therefore regulate so as to give correct pump absorption torque values in accordance with the actual work load (increases and decreases in engine speed).

As described above, the present invention is equipped with the first controller 10*a,* for pre-storing a pump absorption torque curve consecutively increasing and decreasing in steps in accordance with increases or decreases in the speed of the engine, and for outputting a pump absorption torque instruction corresponding to an engine speed signal from the engine speed sensor 5 based on the stored pump absorption torque curve when controlling the variable capacity pump; and the second controller 10*b,* for pre-storing a curve of control current values, going to the control valve 29, corresponding to the pump absorption torque, and for outputting to the control valve 29 a control current value control instruction corresponding to a value of the pump absorption torque instruction from the first controller 10*a* based on the curve of control current values.

The present invention can also be applied to control devices for variable capacity pumps for other construction or manufacturing machinery.

What is claimed is:

1. Apparatus comprising:

an engine;

a variable capacity pump driven by said engine;

a regulator for controlling a swash plate angle of said variable capacity pump;

an engine speed sensor for detecting engine speed of said engine;

a control valve for regulating a control pressure to said regulator;

a first controller for pre-storing a pump absorption torque curve consecutively increasing and decreasing in steps in accordance with increases and decreases in the speed of said engine, and for outputting a pump absorption torque instruction corresponding to an engine speed signal from said engine speed sensor based on said stored pump absorption torque curve when controlling said variable capacity pump; and a second controller for pre-storing a curve of control current values, going to said control valve, corresponding to the pump absorption torque, and for outputting to said control valve a control current value control instruction corresponding to a value of said pump absorption torque instruction from said first controller based on said curve of control current values.

2. An apparatus in accordance with claim 1, wherein the pump absorption torque curve is stored in said first controller in accordance with increases and decreases in a target engine speed and consecutively increases or decreases in steps for the whole region of the engine speed;

wherein a high position pump absorption torque value is larger than a rated engine output torque value for a high engine speed which is higher than a rated engine speed;

wherein an intermediate position pump absorption torque value is an intermediate value, smaller than the rated engine output torque value, for an engine speed lower than the rated engine speed;

wherein a low position pump absorption torque value is smaller than said intermediate position pump absorption torque value for an engine speed which is much lower than the rated engine speed;

wherein the pump absorption torque curve is such that transitions from said high position pump absorption torque value to said intermediate position pump absorption torque value, and transitions from said intermediate position pump absorption torque value to said low position pump torque value are set to have prescribed gradients.

3. An apparatus in accordance with claim 1, wherein the pump absorption torque curve is stored in said first controller as a pattern set as a function of a target engine speed, with said pattern being fixed in such a manner that pump absorption torque does not fluctuate unless said target engine speed is changed.

4. An apparatus in accordance with claim 3, wherein the pump absorption torque curve is stored in said first controller in accordance with increases and decreases in the target engine speed and consecutively increases or decreases in steps for the whole region of the engine speed;

wherein a high position pump absorption torque value is larger than a rated engine output torque value for a high engine speed which is higher than a rated engine speed;

wherein an intermediate position pump absorption torque value is an intermediate value, smaller than the rated engine output torque value, for an engine speed lower than the rated engine speed;

wherein a low position pump absorption torque value is smaller than said intermediate position pump absorption torque value for an engine speed which is much lower than the rated engine speed;

wherein the pump absorption torque curve is such that transitions from said high position pump absorption torque value to said intermediate position pump absorption torque value, and transitions from said intermediate position pump absorption torque value to said low position pump torque value are set to have prescribed gradients.

* * * * *